United States Patent [19]

Booty

[11] Patent Number: 4,533,190

[45] Date of Patent: Aug. 6, 1985

[54] ELECTRICAL POWER TRACK SYSTEM

[76] Inventor: Donald J. Booty, 521 Durham Dr., Frankfort, Ill. 60423

[21] Appl. No.: 559,902

[22] Filed: Dec. 9, 1983

[51] Int. Cl.[3] ..... H01R 25/14

[52] U.S. Cl. ..... 339/21 R

[58] Field of Search ..... 339/20, 21 R, 21 S, 339/22 R, 22 B, 22 T, 23, 24

[56] References Cited

U.S. PATENT DOCUMENTS

| | | | |
|---|---|---|---|
| 1,805,572 | 5/1931 | DeMask | 339/21 R |
| 2,437,579 | 12/1945 | Wilson | 339/21 R |
| 2,875,421 | 2/1959 | Jordan | 339/22 R |
| 3,639,885 | 2/1972 | Yoshiya et al. | 339/21 R |
| 3,832,503 | 8/1974 | Crane | 339/21 R |
| 3,848,715 | 11/1974 | Hesse | 339/21 R |
| 3,980,368 | 9/1976 | Fremont | 339/21 R |
| 3,993,385 | 11/1976 | Seger | 339/21 R |
| 4,032,208 | 6/1977 | Berkenhoff | 339/21 R |
| 4,099,817 | 7/1978 | Booty | 339/22 R |
| 4,181,388 | 1/1980 | Donato | 339/21 R |

FOREIGN PATENT DOCUMENTS

| | | | |
|---|---|---|---|
| 66559 | 12/1982 | European Pat. Off. | 339/22 R |
| 2016334 | 10/1971 | Fed. Rep. of Germany | 339/22 R |

*Primary Examiner*—Neil Abrams

*Attorney, Agent, or Firm*—Welsh & Katz, Ltd.

[57] ABSTRACT

An electrical power track system employing an elongated track having had a plurality of longitudinal slots opening outwardly of laterally opposite side surfaces of the track and providing access to a plurality of offset longitudinal electrical conductors or bus bars, and a gripper member adapted to be mounted in straddle fashion on the track and carrying electrical contacts which are manipulated in response to mounting of he gripper member on the track so as to selectively engage the electrical conductors and facilitate connection of an electric load to an electrical circuit carried by the track. The longitudinal slots are preferably "L" or "T" shaped in transverse cross section and prevent straight-in access to the associated longitudinal conductors carried by the track.

21 Claims, 13 Drawing Figures

FIG. 1
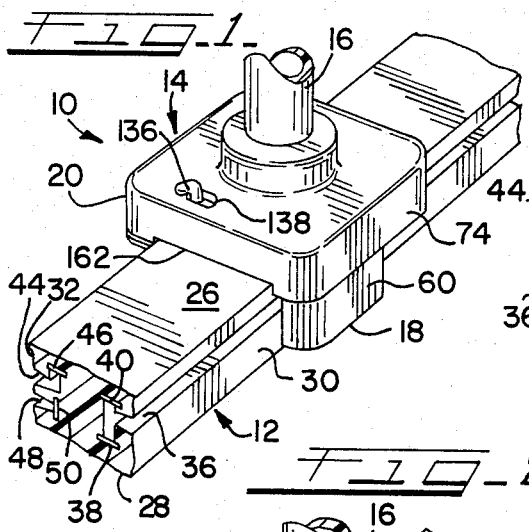
FIG. 4
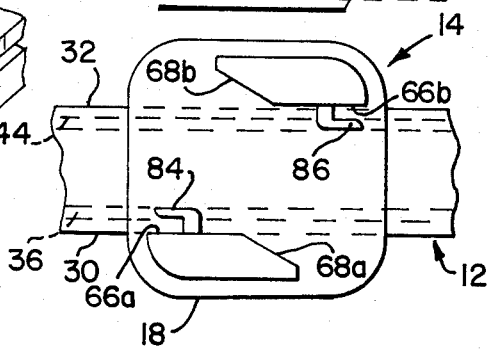
FIG. 2
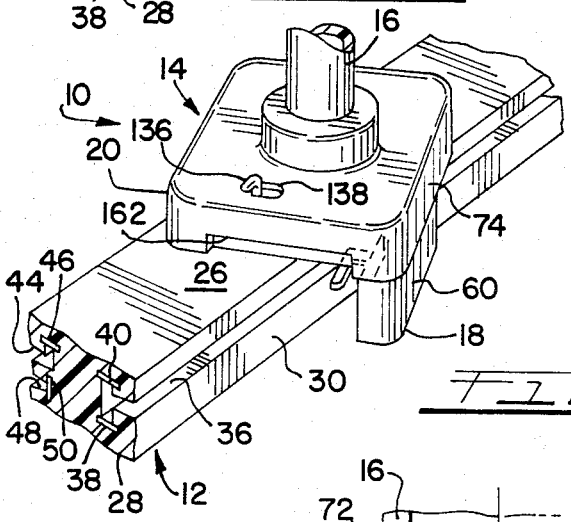
FIG. 3
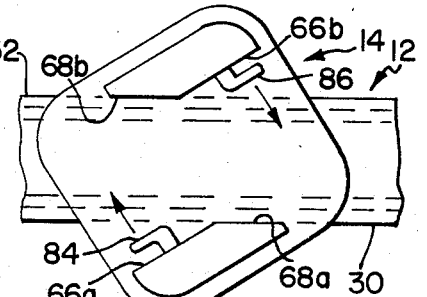
FIG. 9
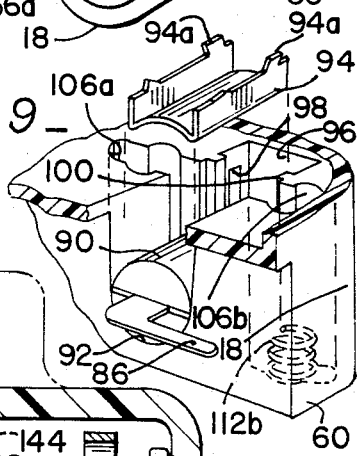
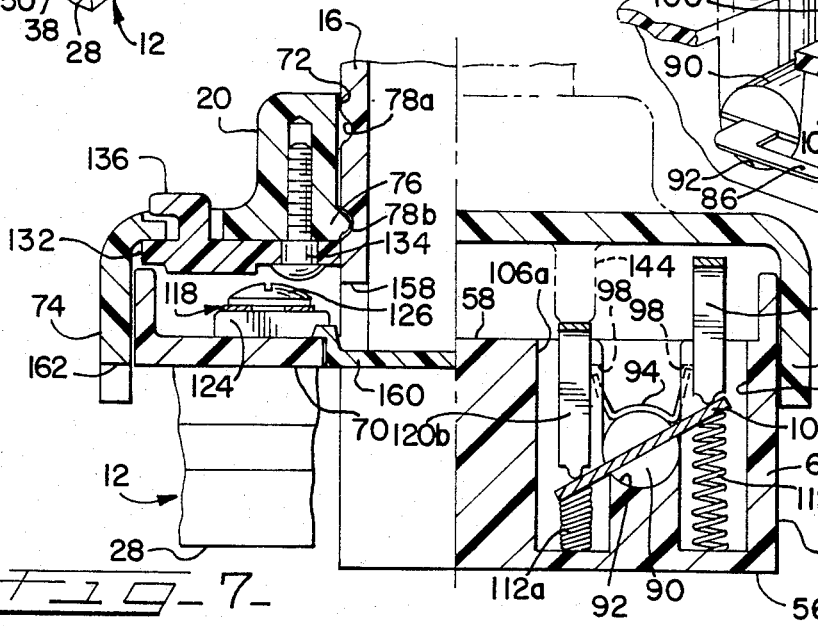
FIG. 7

10
12
14
16
18
20
26
28
30
32
36
38
40
44
46
48
50
58
60
74
84
86
88
90
100
102a
102b
104a
104b
106a
106b
110a
112a
112b
118
118a
118b
118c
118d
118e
120
120a
120b
124
126
128a
128b
132
134
136
138
140
144
66a
66b
68a
68b
86a
88a
84b
7
8

ELECTRICAL POWER TRACK SYSTEM

BACKGROUND OF THE INVENTION

The present invention relates generally to electrical power distribution systems, and more particularly to an electrical power track system employing a novel track and gripper member which enable cooperative connection to facilitate connection of an associated electrical load to a single circuit or to a selected one of a two circuit system.

Electrical power track systems of the type employing an elongated track having a plurality of longitudinally extending conductors or bus bars accessible to enable releasable engagement by electrical power contacts carried by a gripper or tap member are generally known. See, for example, U.S. Pat. Nos. 3,639,885 to Yoshiya, 3,832,503 to Crane, and 4,032,208 to Berkenhoff, each of which discloses a track lighting system employing an elongated track having an internal channel providing access to longitudinal conductors so that internal insertion of electrical contacts carried by a gripping or tap member into the longitudinal channel facilitates connection of the contacts and an associated load in a single electrical circuit. Other electrical power track systems are known which facilitate selective connection of an electrical load to either one of a plurality of different circuits carried by a common track carrier. See, for example, U.S. Pat. No. 3,848,715 to Hesse, 3,980,368 to Fremont and 4,181,388 to Donato. An example of a track lighting system employing a rotatable gripper or tap member adapted to be placed over a track in straddling fashion and rotated so as to effect contact between internally directed electrical contacts and externally exposed longitudinal conductors carried by the track is exemplified by U.S. Pat. No. 3,437,579 to Wilson.

For the most part, the known electrical power track systems exhibit a significant drawback in that the tracks and associated longitudinal conductors or bus bars are generally accessible through straight-in insertion or penetration of an electrically conductive instrumentality, such as a metal object, with the result that serious electrical shock may occur to an unknowing child or to a careless adult. A corollary to this adverse safety drawback is that these power track systems have failed to meet generally accepted safety requirements, and have thus failed to receive safety certification for commercial and private use, as by Underwriters Laboratories, Inc. U.S. Pat. Nos. 4,099,817 and 4,178,382, both issued to the present applicant, disclose track lighting arrangements which substantially overcome the aforementioned drawbacks of most electrical power track systems by inhibiting straight-in access to the electrical conductors or bus bars carried by the tracks.

SUMMARY OF THE INVENTION

A general object of the present invention is to provide a novel electrical power track system which facilitates connection of an electrical load to an electrical circuit carried within an elongated track.

A more particular object of the present invention is to provide an electrical power track system which employs an elongated track having a plurality of longitudinal slots opening outwardly of laterally opposite side surfaces of the track and providing access to a plurality of longitudinal electrical conductors or bus bars through longitudinal slots of "L" or "T" shaped transverse configuration, and a gripper member adapted to be mounted in straddle fashion on the track and carrying electrical contacts which are caused to penetrate the longitudinal slots and be rotatably manipulated in response to mounting of the gripper member on the track so as to selectively engage the electrical conductors and facilitate connection of a load to an electrical circuit carried by the track.

A feature of the electrical power track system in accordance with the invention lies in the provision of an elongated track having at least one longitudinal slot in each of a pair of laterally opposite side surfaces, each of the slots providing indirect access to at least one longitudinal conductor or bus bar so as to prevent straight-in access to the corresponding longitudinal conductor, and a gripper member adapted to be mounted in straddle fashion on the track and carrying electrical contacts adapted in a first orientation to project into the longitudinal slots, the gripper member further having actuator means operative to manipulate the contacts so as to effect selective engagement of the contacts with the corresponding longitudinal conductors in response to mounting of the gripper member on the track whereby to enable selective connection of an electrical load to an electrical power circuit.

Another feature of the electrical power track system in accordance with the invention lies in the provision of a novel gripper member which includes a gripper base having a shroud mounted thereon operative in a first position relative to the gripper base to enable the gripper base to be placed in straddle fashion on the track and rotated to effect projection of contacts into longitudinal slots formed in laterally opposite sides of the track, the shroud being movable to a second position relative to the gripper base so as to cooperate with the track in a manner to prevent rotation and release of the gripper base from the track.

Still another feature of the electrical power track system in accordance with the present invention lies in the provision of a novel track having longitudinal slots of "L" or "T" shaped transverse cross section formed in laterally opposite outwardly facing side surfaces of the track so as to prevent direct access to longitudinal conductors or bus bars carried by the track, and a gripper member adapted to be placed on the track in straddle fashion and having a pair of rotatable generally L-shaped contact members adapted to project into the longitudinal track slots when in a first orientation, and actuator means operable in response to mounting of the gripper member on the track to effect rotation of the contacts so as to effect selective engagement of the contacts with the longitudinal conductors carried by the track.

Yet another feature of the invention lies in the provision of a novel track for use in an electrical power circuit and which includes a track body having longitudinal slots formed in generally laterally opposite outwardly facing surfaces, the slots opening outwardly of the corresponding track surfaces and having substantially "T" or "L" shaped transverse configurations so as to provide access to longitudinal bus bars carried by the track but preventing straight-in access to the bus bars.

Further objects, features and advantages of the present invention, together with the organization and manner of operation thereof, will become apparent from the following detailed description of the invention when taken in conjunction with the accompanying drawings wherein like reference numerals designate like elements throughout the several views.

BRIEF DESCRIPTION OF THE DRAWINGS

FIG. 1 is a fragmentary perspective view illustrating a track light system constructed in accordance with the present invention;

FIG. 2 is a fragmentary perspective view similar to FIG. 1, but illustrating the gripper member during an intermediate stage of mounting on the track;

FIG. 3 is a schematic plan view showing the position of the electrical contacts relative to the track with the gripper member in the stage of mounting on the track as illustrated in FIG. 2;

FIG. 4 is a schematic plan view similar to FIG. 3 but showing the gripper base in operating position on the track as illustrated in FIG. 1;

FIG. 7 is a sectional view taken substantially along line 7—7 of FIG. 6, looking in the direction of the arrows;

FIG. 9 is a fragmentary perspective view illustrating the manner of supporting the electrical contacts within the gripper base;

DESCRIPTION OF PREFERRED EMBODIMENT

Figures 5, 6, 10:
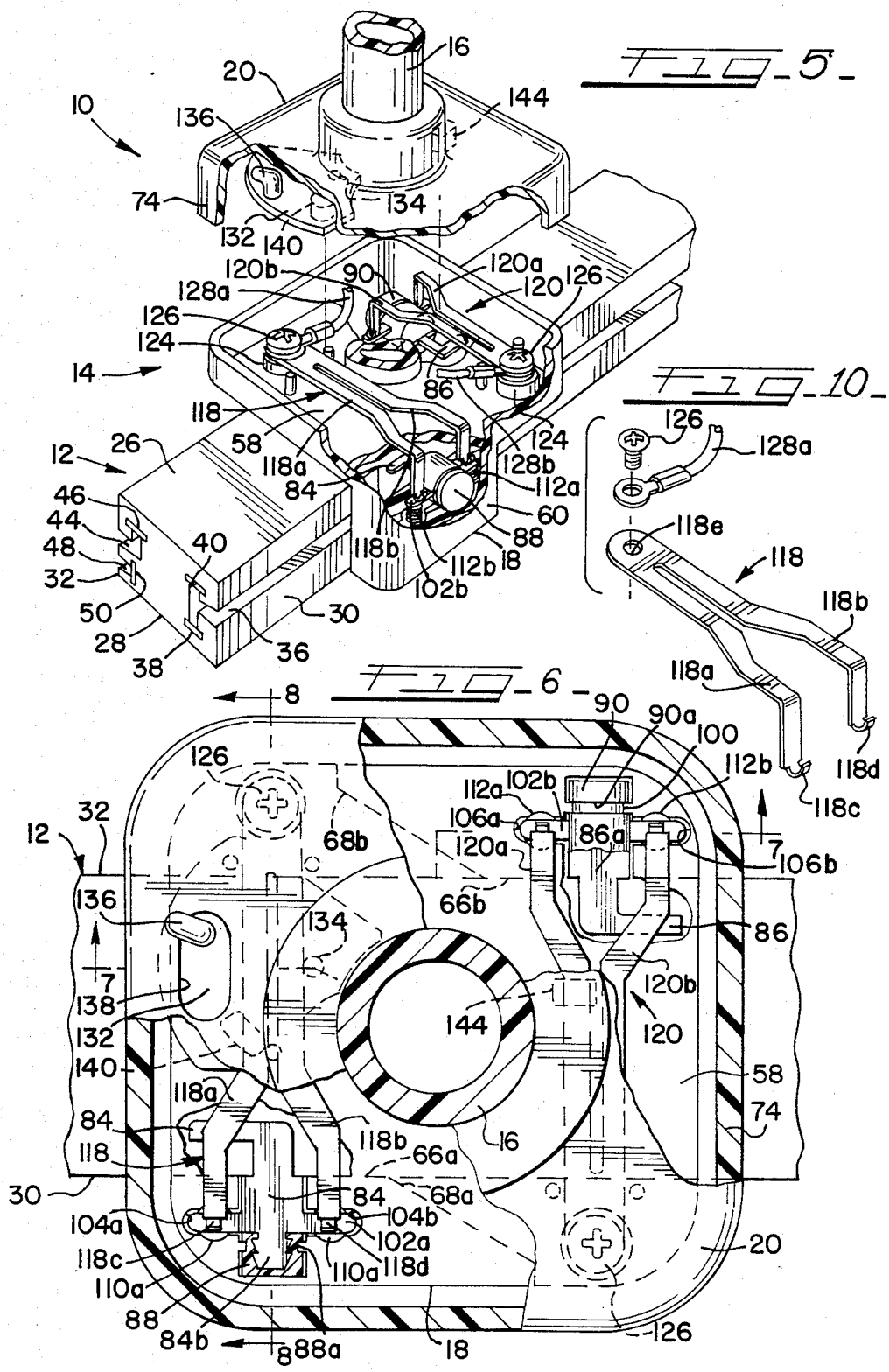
FIG. 5 is a fragmentary pespective view of the gripper member and track as shown in FIG. 1, but with the shroud cover shown in a detached position and with portions removed to better illustrate the internal components of the gripper member.
FIG. 6 is a plan view of the gripper member in assembled relation on the track, portions being broken away for purposes of clarity.
FIG. 10 is a perspective view illustrating a spring arm actuator as employed in the gripper base.

Referring now to the drawings, and in particular to FIGS. 1–4, an electrical power track system constructed in accordance with one embodiment of the present invention is indicated generally at 10. The electrical power track system 10, which may hereinafter be referred to as a power track system, includes an elongated track, a portion of which is indicated generally at 12, on which may be mounted a gripper member, indicated generally at 14. The gripper member 14, which may alternatively be termed at tap, serves to carry and provide electrical power to an electrical load (not shown), such as a light fixture or other electrical device, through a stem 16. As will become apparent, the gripper member or tap 12 may be releasably affixed to the track 14 at substantially any selected position therealong.

The gripper member 14 includes a gripper base portion 18 and a shroud or cover member 20 which is carried by and movable relative to the gripper base between a first position enablng the gripper base to be placed in straddle fashion over the track and rotated about the longitudinal axis of stem 16, and a second locking position cooperative with the gripper base and track so as to prevent rotation of the gripper base relative to the track as will be hereinafter described.

Figure 8:
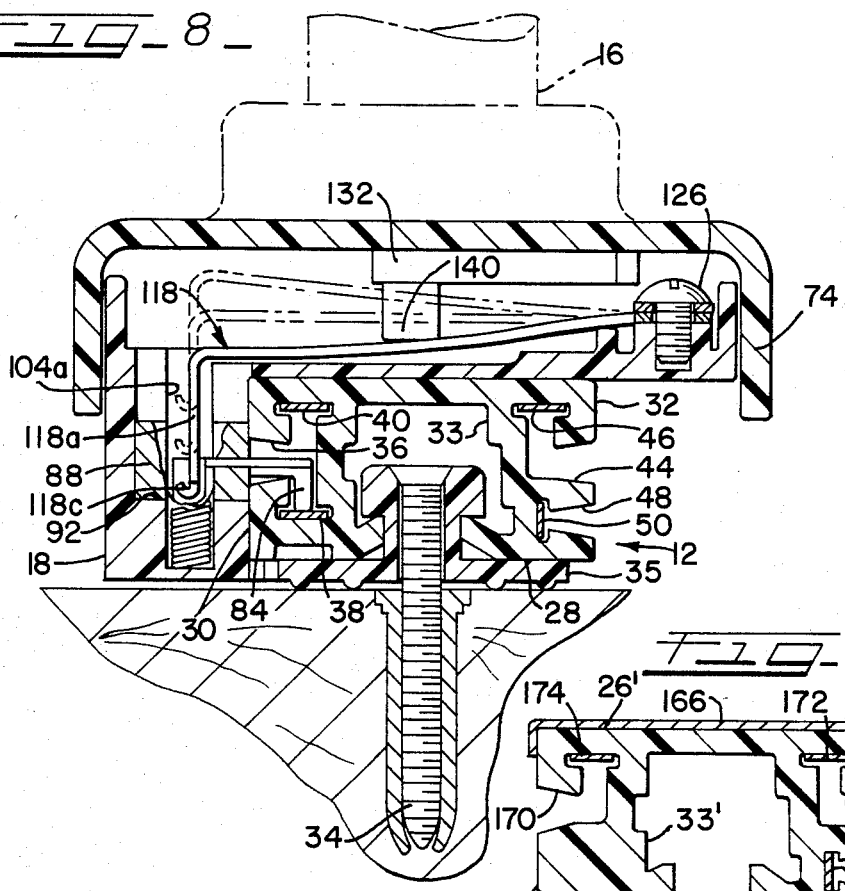
FIG. 8 is a sectional view taken substantially along line 8—8 of FIG. 6, looking in the direction of the arrows.

With particular reference to FIGS. 5–8, the track 12 has a generally rectangular transverse cross-sectional configuration defined by upper and lower substantially parallel planar surfaces 26 and 28, respectively, interconnected through laterally opposite parallel side surfaces 30 and 32 which preferably lie in planes normal to the upper and lower surfaces 26 and 28. Because it is frequently desirable to mount the track 12 on a ceiling surface or the like so that the stem 16 and associated light fixture extend downwardly, what has been termed the upper surface 26 of the track will in that case actually comprise the lower exposed surface of the track, while the surface 28 will be mounted closely adjacent a support surface. To facilitate mounting of the track 12, a recess or chamber 33 is formed generally along the longitudinal axis of the track. The recess 33 opens outwardly of surface 28 and enables mounting to a support surface through screws 34 and associated mounting or spacer brackets, one of which is indicated at 35, in a manner as illustrated in FIG. 8. The screws 34 and associated spacer brackets 35 enable releasable mounting of the track to the corresponding support surface so as to provide portability as required for certification by, for example, Underwriters Laboratories, Inc., for cord connected devices. With the track 12 so mounted on a support surface, the uninterrupted planar surface 26 lends itself to decoration in any suitable manner so that the track may be made esthetically compatible with its surroundings.

The lateral side surface 30 of track 12 has a slot 36 formed longitudinally therealong which is of generally T-shape in transverse cross section and opens outwardly from side surface 30 so as to provide access to two longitudinally extending generally parallel electrical conductors or bus bars 38 and 40. The conductors or bus bars 38 and 40 are generally rectangular in transverse cross section and lie in planes substantially parallel to and spaced from a medial plane passing into slot 36 parallel to the top surface 26 of the track. In this manner the conductors 38 and 40 are only indirectly accessible through slot 36; that is, an electrically conductive instrumentality, such as a screwdriver or the like, inserted straight into slot 36 will not engage either of conductors 38, 40.

To further facilitate portability, the track 12 may be formed from a plurality of substantially identical track sections adapted for end-to-end connection. Each track section may be formed from an extruded polymer which optionally may have an extruded metal shroud or cover thereon as will be described in conjunction with the embodiment of FIG. 13. In this manner, the rectangular shaped conductors or bus bars 38 and 40 may be embedded in the track and have their opposite ends extending into end caps (not shown) such that common ends of the conductors extend through and longitudinally outwardly from one of the end caps, while the opposite ends of the conductors are affixed within internal contacts within an end cap so as to enable end-to-end connection of similar sections of track through male and female type conductor connections, thus allowing continuity of circuits through a selected number of track sections, as is known.

The lateral side surface 32 of track 12 has a longitudinally extending slot 44 formed therealong which is of generally L-shape in transverse cross section and intersects surface 32 so as to provide access to a longitudinally extending generally rectangular common electrical conductor or bus bar 46 having its opposite ends arranged in similar fashion to the conductors 38 and 40 to facilitate end-to-end connection of similar sections or lengths of track. The conductor or bus bar 46 is also rectangular in transverse cross section and lies in a plane substantially parallel to and spaced from a medial plane passing into slot 44 in parallel relation to the top track surface 26. The conductor 46 is only indirectly accessible through slot 44, thus preventing straight-in insertion of an electrically conductive instrumentality and contact with the conductor 46.

A second longitudinally extending slot 48 is formed in the lateral side surface 32 of track 12 so as to open outwardly therefrom and provide access to a longitudinal rectangular earth ground safety conductor 50 retained in track 12 in similar fashion to the conductors 38, 40 and 46. The earth ground conductor 50 facilitates safety grounding of any exposed metal or socket brackets of the track light system which are not intended for electrical conductors. The conductors 38, 40 and 46 are adapted for connection to a power supply so as to establish separate circuits for selective connection of a load thereto. For example, conductors 38 and 46 may form a first circuit combination and conductors 40 and 46 may form a second circuit combination.

As aforementioned, the gripper member 14 includes the gripper base 18 and the shroud or cover member 20. Referring to FIGS. 5–8, the gripper base 18 is preferably made of an electrically nonconductive material, such as a suitable plastic, and has a generally rectangular configuration defining a lower mounting surface 56, an upper recessed surface 58 and an outer peripheral side wall surface 60. In the illustrated embodiment, the side wall surface 60 is generally square in transverse cross-sectional configuration but with rounded corners. With particular reference to FIG. 6, taken with FIGS. 3 and 4, the gripper base 18 has a channel or recess, indicated generally at 64, formed in the mounting surface 56 such that the channel intersects the outer peripheral wall 60 and enables the gripper base to be placed over track 12 in straddle fashion. The opposite side surfaces of channel 64 are defined by a first pair of laterally spaced internal wall surfaces 66*a* and 66*b* which lie in parallel planes substantially perpendicular to the plane of mounting surface 56, and a second pair of laterally spaced internal wall surfaces 68*a* and 68*b* which are contiguous, respectively, to surfaces 66*a* and 66*b* and lie in parallel planes substantially perpendicular to the mounting surface 56. The surfaces 68*a* and 68*b* subtend angles of approximately 30° with the planes of the associated surfaces 66*a* and 66*b*. The upper boundary of channel 64, as considered in FIG. 7, is defined by a generally planar surface 70. In this manner, channel 64 enables the gripper base 18 to be placed over the track 14 in straddle fashion with the surfaces 68*a* and 68*b* in generally confronting relation to the lateral side surfaces 30 and 32 of track 12, whereafter the gripper base may be rotated about an axis normal to the mounting surface 56 through an angle of approximately 30° so as to bring the wall surfaces 66*a* and 66*b* into confronting relation with the lateral side surfaces of the track.

The tubular stem 16 may be formed integral with or otherwise suitably secured to the gripper base 18 so as to extend upwardly or outwardly from the recessed surface 58 in normal relation thereto and at substantially the geometrical center of surface 58. As illustrated in FIG. 7, the shroud 20 has an internal cylindrical bore 72 which receives the stem 16 in sliding relation therethrough so as to enable movement of the shroud relative to the gripper base 18. The shroud 20 has a peripheral generally rectangular shaped skirt wall 74 which is configured to lie in closely spaced external relation to the outer peripheral wall surface 60 of gripper base 18. The shroud 20 has a pair of diametrically opposite detents or lip projections, one of which is indicated at 76, formed within bore 72, each of the detents being adapted for releasable engagement with either one of a corresponding pair of spaced recesses 78*a* and 78*b* formed in the outer surface of stem 16. In this manner, the shroud 20 may be moved relative to the gripper base 18 between a first position wherein the detents 76 are disposed within the corresponding upper recesses 78*a*, and a second position wherein the detents 76 are disposed within the corresponding recesses 78*b*, as illustrated in FIG. 7.

To enable electrical connection of an electrical load (not shown), such as an electric light carried on the outer end of the stem 16, to selected ones of the track conductors 38, 40 and 46, the gripper base 18 carries a pair of generally flat L-shaped electrical contacts 84 and 86 which extend outwardly from the parallel channel surfaces 66*a* and 66*b* in normal relation thereto. The contacts 84 and 86 are each normally disposed in an orientation enabling them to project into the slots 36 and 44, respectively, when the gripper base is initially mounted on the track and rotated so that channel surfaces 66*a,b* are in confronting relation with the track surfaces 30 and 32, respectively. Each of the contacts 84 and 86 is supported for rotation about an axis generally normal to its corresponding channel surface 66*a,b* by means of a cylindrical support 88 and 90, respectively. Referring to FIGS. 6 and 9, each of the contacts 84 and 86 is preferably made from a relatively flat electrically conductive metallic material and includes an L-shaped outer contact end formed integral with a flat body 84*a*, 86*a*, respectively, which is inserted within a suitable diametral slot in the corresponding support 88, 90 and retained therein such as by a serrated tail portion as indicated at 84*b* in FIG. 6. Each of the cylindrical supports 88 and 90 is rotatably supported within a corresponding semicylindrical recess, such as indicated at 92 in FIG. 9, and is retained by a retaining clip 94 adapted to be inserted into a rectangular opening 96 communicating with the recess surface 92 such that locking tabs or fingers 94*a* on the retaining clip are received within suitable recesses 98 formed in the gripper base. Each cylindrical support 88, 90 has an annular groove 88*a* and 90*a*, respectively, formed therein which receives a projection 100 extending internally of recess 96 so as to retain the supports axially within the gripper base as illustrated in FIGS. 6 and 9.

It will be appreciated that the contacts 84 and 86 must lie in planes generally parallel to the upper surface 26 of track 12 in order for the contacts to enter slots 36 and 44 when the gripper base is straddling the track and is rotated about the axis of stem 16 as aforedescribed. With contacts 84, 86 projecting into slots 36 and 44, respectively, the contact 84 must be selectively rotated to engage either of conductors 38 and 40. Similarly, contact 86 must be rotated to engage the common conductor 46. To this end, each of the contacts 84, 86 is formed integral with or otherwise secured to a corresponding electrically conductive transverse arm, indicated at 102*a* and 102*b*, respectively, which extends radially outwardly from diametrically opposite sides of the associated cylindrical support 88, 90. The outwardly extending ends of arms 102*a*, 102*b* are received within suitable recesses within the gripper base, such as indicated at 104*a,b* and 106*a,b*, respectively.

The contacts 84 and 86 are biased to positions lying in planes parallel to the gripper base mounting surface 56 by pairs of coil compression springs 110*a,b* and 112*a,b*, respectively, each of which acts between the bottom of the associated recess 104*a,b* or 106*a,b* and the associated actuating arms 102*a,b*.

Selective rotation of the contacts 84 and 86 is effected by actuating means including substantially identical conductive spring members, indicated generally at 118 and 120. As illustrated in FIG. 10, the spring members are preferably made from a conductive metallic spring material and each is formed as a bifurcated member defining a pair of contact spring arms such as indicated 118*a* and 118*b* for spring member 118. The spring arms 118*a,b* are generally L-shaped in side profile and terminate in curved contact ends 118*c* and 118*d*, respectively. Each conductive spring member has an opening formed therethrough, such as indicated at 118*e* in FIG. 10, to enable mounting on a corresponding boss 124 formed on the gripper base 18, as through a screw 126. Electrical conductor wires 128*a* and 128*b* are connected respectively, to the conductive spring members 118 and 120 and are adapted to extend through the tubular stem 16 for connection to an electrical load. When in assembled relation, the contact ends 118*c,d* and 120*c,d* of the spring members 118, 120 cooperate with the associated compression springs 110*a,b* and 112*a,b* to bias the contacts 84 and 86 to positions lying in planes generally parallel to the mounting surface 56 of the gripper base 18.

To effect selective rotation of the contact 84, the shroud 20 carries an actuator plate 132 through a pivot pin or screw 134 which defines a pivot axis about which the actuator plate 132 may be rotated. Movement of the actuator plate 132 is controlled through a control knob 136 which is affixed to and extends upwardly from the actuator plate 132 through an elongated slot or opening 138 within the shroud 20. The actuator plate 132 carries a depending actuator arm or boss 140 which is selectively positionable to overlie either of the spring arms 118*a* or 118*b*. With the actuating arm 140 positioned to overlie the spring arm 118*a* as illustrated in FIGS. 5, 6 and 8, movement of the shroud 20 from its raised to its lowered position relative to the gripper base 18 effects depressing of spring arm 118*a* and thereby exerts a downward force on the associated end of the transverse contact arm 102*a* to effect a corresponding rotation of contact 84 causing it to engage the conductor or bus bar 38.

In similar fashion, if it is desired that contact 84 engage the track conductor 40, the actuator plate 132 is rotated by means of the control knob 136 to position the actuating arm 140 over the spring arm 118*b*. Thereafter, movement of the shroud to its lowered position over the gripper base effects downward movement of spring arm 118*b* and a corresponding rotational movement of the contact 84 to engage conductor 40. In this manner, raising shroud cover 20 to a position wherein the detents 76 are disposed within recesses 78*a* enables the spring arms 118*a,b* and springs 110*a*, 110*b* to return the contact 84 to a neutral position generally parallel to the mounting surface 56, thus facilitating removal of contact 84 from slot 36.

In the illustrated embodiment, the contact 86 is normally positioned to enable insertion into the L-shaped slot 44 when the gripper member 18 is mounted on track 12. The contact 86 must thereafter be rotated to engage the track conductor or bus bar 46. To effect such rotation of contact 86, the shroud 20 carries a fixed actuating arm or boss 144 which is positioned to engage the spring arm 120*a* upon movement of the shroud to its lowered position relative to the gripper base thus causing the contact end 118*c* to exert a downward force on contact arm 90 sufficient to rotate contact 86 and effect engagement thereof with conductor 46. In this manner, movement of shroud 20 to its raised position relative to the gripper base 18 enables the spring arms 120*a,b* and coil spring 112*a,b* to return contact 86 to its neutral position enabling withdrawal from slot 44.

Figure 11:
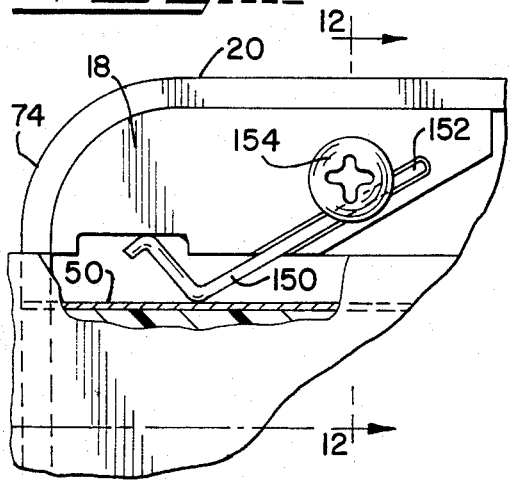
FIG. 11 is a fragmentary bottom view of the gripper base and track with portions broken away to illustrate the safety ground contact and conductor.
Figure 12:
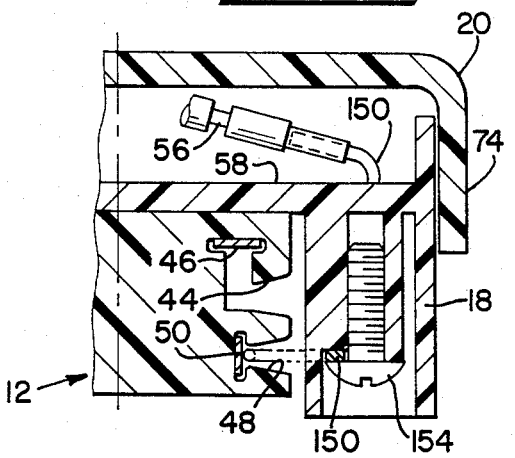
FIG. 12 is a fragmentary sectional view taken substantially along line 12—12 of FIG. 11.

Preferably, the gripper member 14 also carries a relatively stationary electrical contact, indicated at 150 in FIGS. 11 and 12, which is adapted to project into slot 48 for conductive engagement with the safety ground conductor or bus bar 50 when the gripper member is mounted on track 12. The stationary contact 150 may be mounted within a suitable slot 152 formed in the mounting surface 56 of the gripper base 18 and retained therein through a screw 154. An electrical conductor 156 (FIG. 12) is connected to the grounding conductor 150 and facilitates connection of the safety ground to any exposed metal or socket brackets on the load device carried by the gripper member, other than any metallic part or connector which is intended to be connected in the primary power circuitry associated with conductors 38, 40 and 46.

Having thus described a preferred embodiment of an electrical power track system in accordance with the present invention, it will be appreciated that the gripping member 14 may be selectively mounted at substantially any position along the length of the track 12 by moving the shroud cover 20 to a raised position relative to the gripper base 118 so as to enable the gripper base to be placed over the track 12 in straddling fashion as illustrated schematically in FIG. 3. With the gripper base straddling track 12 and with the shroud 20 in its raised position, the gripper base may be rotated about the axis of stem 16 to a position wherein the channel surfaces 66*a* and 66*b* confront the laterally opposite side surfaces 30 and 32 of the track, such movement causing simultaneous insertion of the contacts 84 and 86 into the track slots 36 and 44. With the gripper base 18 thus positioned on track 12, and with the actuating plate 132 positioned such that actuating arm 140 overlies spring arm 118*a*, movement of shroud 20 to a position wherein the detents 76 engage recesses 78*b* causes the actuating arms 140 and 144 to depress the spring arms 118*a* and 120*a* thereby causing contacts 84 and 86 to rotate and engage track conductors 38 and 46, respectively. In this manner, the electrical load carried by stem 16 is electrically connected to conductors 38 and 46, it being understood that the conductors 128*a,b* and 156 extend through a wireway passage, such as indicated at 158 in the bottom of stem 16 in FIG. 7, and upwardly through the stem. Preferably, a cap plug 160 covers the lower end of the tubular stem 16.

In accordance with one feature of the invention, the shroud 20 is recessed on opposite sides of the peripheral skirt wall 74 such as indicated at 162 in FIGS. 1 and 2, such that when the shroud is moved to its lowered position relative to the gripper base, the recess 162 receives the upper surface 26 of track 12 therein so as to prevent rotation of the shroud and gripper base 18. When it is desired to release the gripper member 14 for positioning on or removal from track 12, the shroud 20 is raised to release it from its locking relation with the track and gripper base, and to release spring contact arms 118*a,b* and 120*a,b*. In this condition, the gripper base 18 may be rotated in a direction to release or remove the contacts 84, 86 and 150 from their respective slots 36, 44 and 48, thus facilitating respositioning or removal of the gripper member relative to the track. The slots 36, 44 and 48 are preferably defined by slightly inclined wall surfaces to facilitate entry of the contacts 84, 86 and 150, as illustrated in FIG. 8.

Figure 13:
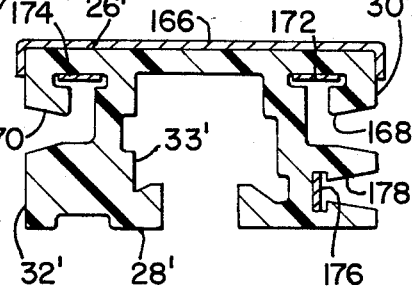
FIG. 13 is a transverse sectional view of an alternative electrical power track in accordance with the invention.

FIG. 13 illustrates an alternative track configuration, indicated generally at 12', in accordance with the present invention. The track 12' enables connection of an electrical load to a single electrical circuit and is generally similar in its outer configuration to the aforedescribed track 12 in that it is generally rectangular in transverse cross section and has generally parallel upper and lower surfaces 26' and 28' and laterally opposite side surfaces 30' and 32'. The track 12' may be formed from an extruded polymer and may have a metallic shroud 166 of generally inverted U-shape fixed thereon in a manner to protect the polymer track body. The track 12' has a longitudinal recess 33' formed therein to facilitate releasable mounting to a support surface such as a wall or ceiling surface.

The track 12' has a pair of longitudinal slots 168 and 170 formed in the side surfaces 30' and 32', respectively, so as to intersect or open outwardly of the track side surfaces. The slots 168 and 170 are generally symmetrical about the longitudinal axis of track 12' and are substantially L-shaped in transverse cross-sectional configuration. A pair of electrical conductors or bus bars 172 and 174 are carried by track 12' so as to lie in planes generally parallel to the upper surface 26' of the track and are exposed to the innermost ends of the L-shaped slots 168, 170, respectively. The L-shaped slots and associated conductors or bus bars 172, 174 are such that the bus bars are inaccessible through straight-in insertion of a generally straight electrically conductive object, such as the conductive shank of a conventional screwdriver. The conductors or bus bars 172, 174 and associated slots enable insertion of generally L-shaped contacts, such as the aforedescribed contacts 84 and 86 carried by the gripper member 14, and rotation of the contacts to engage the track conductors. It will be appreciated that the gripper member 14 may be modified for use with the track 12' by providing two L-shaped contacts similar to contact 86 which are adapted to be inserted into the slots 168, 170 upon initial mounting of the gripper member on track 12', and which are selectively rotated to engage the corresponding conductors 172, 174 upon movement of the shroud cover 20 to its locking position with the track.

A safety ground conductor 176 may also be provided in track 12' for direct access through a longitudinal slot 178 by a ground conductor, such as conductor 150, carried by a gripper member intended for use with track 12'.

It will be appreciated that further alternative embodiments of the tracks 12 and 12' may be provided in accordance with the present invention which employ longitudinal slots opening outwardly of outer surfaces of the track and which provide indirect access to longitudinal electrical conductors or bus bars carried by the track, but which prevent access to the bus bars through straight-in insertion of generally straight electrically conductive objects. For example, both of the slots 168, 170 may be T-shaped in transverse cross section similar to slot 36 in the track 12, or each may comprise a combination "L" and "T" shaped slot.

While a preferred embodiment of the track light system in accordance with the invention has been illustrated and described, it will be understood to those skilled in the art that changes and modifications may be made therein without departing from the invention in its broader aspects. Various features of the invention are defined in the following claims.

What is claimed is:

1. An electrical power track system comprising an elongated track defining a pair of generally opposite side surfaces, each of said side surfaces having at least one open slot extending longitudinally therealong, each of said slots providing access to at least one longitudinally extending electrical conductor positioned in offset relation to the corresponding slot, a gripper member including a gripper base having a channel therethrough enabling said gripper base to be mounted on said track in straddle fashion and be rotated relative to said track after mounting thereon in said straddle fashion such that surfaces defining said channel are disposed in generally confronting relation to said opposite track side surfaces, a pair of electrical contacts carried by said gripper base such that each contact extends outwardly from a corresponding one of said channel defining surfaces in a position to project into the corresponding slot when said gripper base is rotated so that said channel defining surfaces are in said generally confronting relation, and actuator means carried by said gripper base to cooperative association with said electrical contacts and being operative after said rotation of said gripper base to effect movement of said contacts so as to cause selective engagement of said contacts with said electrical conductors when said electrical contacts project into said slots.

2. The track system as defined in claim 1 wherein at least one of said open slots in said track has a generally T-shaped transverse cross-sectional configuration and provides access to a pair of discrete longitudinal electrical conductors through a single entry slot, said longitudinal conductors being offset relative to said entry slot so as to prevent direct access to said conductors through generally straight-in insertion of an object into the corresponding slot, the corresponding electrical contact carried by said gripper base being operative to extend into said T-shaped slot and being rotatable by said actuator means in a manner to enable selective engagement with either of said discrete electrical conductors.

3. The track system as defined in claim 1 wherein said gripper member includes a shroud movable relative to said gripper base between a first position enabling said gripper base to be rotated relative to said track when in straddling fashion thereon, and a second position operative to prevent said gripper base from being rotated relative to said track when in said straddling relation thereon.

4. The track system as defined in claim 1 wherein at least one of said open slots in said track is generally L-shaped in transverse cross section and provides access to a longitudinal electrical conductor carried by said track in offset relation to the entry end of the corresponding slot so as to prevent direct access to said conductor, the corresponding electrical contact carried by said gripper base being operative to project into said L-shaped slot and being rotatable by said actuating means in a manner to enable selective engagement with the corresponding longitudinal conductor.

5. The track system as defined in claim 4 wherein the other of said open slots in said track has a generally T-shaped transverse cross-sectional configuration and provides access to a pair of discrete longitudinal electrical conductors through a single entry slot, said pair of longitudinal conductors each being offset relative to said entry slot so as to prevent direct access to said conductors through generally straight-in insertion of an object into the corresponding slot, the corresponding electrical contact carried by said gripper base being operative to extend into said T-shaped slot and being rotatable by said actuator means in a manner to enable selective engagement with either one of said pair of discrete electrical conductors.

6. The track system as defined in claim 3 wherein said gripper base includes a stem extending outwardly therefrom, said shroud being slidable on said stem between said first and second positions.

7. The track system as defined in claim 6 including means mutually cooperable with said gripper base and said shroud so as to releasably retain said shroud in either of said first and second positions.

8. The track system as defined in claim 3 wherein said shroud includes recess means cooperative with said track so as to prevent rotation of said gripper base when said shroud is in its said second position and said gripper base is in straddling fashion on said track.

9. The track system as defined in claim 3 wherein each of said electrical contacts is carried by said gripper base in a manner to enable rotation of said contacts about corresponding axes transverse to the longitudinal axis of said track when said gripper base is mounted in straddling relation on said track, said actuator means being operatively associated with said contacts in a manner to effect selective rotation thereof in response to positioning of said gripper base such that said channel defining surfaces are in confronting relation with the opposite side surfaces of said track.

10. The track system as defined in claim 9 wherein each of said electrical contacts is carried by a cylindrical support rotatably supported by said gripper base, each of said contacts having outwardly extending arms thereon, said actuator means including contact spring means carried by said gripper base and cooperative with said contact arms in a manner to effect selective rotation of the corresponding contacts in response to movement of said shroud to its said second position.

11. The track system as defined in claim 9 wherein said actuator means includes means carried by said shroud and externally adjustable to enable selective rotation of at least one of said electrical contacts.

12. The track system as defined in claim 5 wherein actuator means includes a shroud carried by said gripper base for movement between first and second positions relative to said gripper base, actuator arm means carried by said gripper base in cooperative associated with said electrical contacts, and means mutually cooperable with said shroud and said actuator arm means in a manner to effect selective movement of said actuator arm means and selective rotation of said electrical contacts when said shroud is moved from its said first to said second positions.

13. The track system as defined in claim 12 wherein said electrical contacts include generally L-shaped contact ends, and means biasing said contacts to positions wherein said L-shaped contact ends lie in substantially parallel planes when said shroud is in its said first position.

14. An electrical power system comprising an elongated track having substantially parallel laterally opposite side surfaces, at least one slot formed longitudinally in each of side surfaces and opening outwardly therefrom, at least one electrical conductor extending longitudinally of said track adjacent each of said slots and being accessible through the corresponding slot, and a gripper member including a gripper base defining a mounting surface having a channel therethrough configured to enable said gripper base to straddle said track, said channel being defined by first and second pairs of substantially parallel internal wall surfaces configured to enable said gripper base to be mounted over said track in a first straddle fashion position and rotated to a second staddle position so as to effect close confrontation between selected ones of said internal wall surfaces and said opposite side surfaces of said track, said gripper member including a shroud cover carried by said gripper base and movable relative thereto between a first position enabling said gripper base to be positioned on said track in said first straddle fashion position and rotated relative thereto to said second straddle position, and a second position preventing rotation of said gripper base relative to said track after mounting thereon in said second straddle position, said gripper base having at lease one electrical contact extending outwardly from each of said selected ones of said internal wall surfaces in positions to project into the corresponding longitudinal slots in said opposite side surfaces when said gripper base is rotated to effect said close confrontation between said selected ones of said internal wall surfaces and said opposite side surfaces of said track.

15. The track system as defined in claim 14 wherein said gripper base has a stem extending outwardly therefrom, said shroud cover being mounted on said stem and movable between first and second positions relative to said gripper base, said shroud cover in its said first position enabling said gripper base to be mounted over said track in straddle relation thereon and rotated relative to said track, said shroud member in its said second position being cooperative with said track so as to prevent rotation of said gripper base relative to said track when in straddle relation thereon.

16. An electrical power arrangement comprising an elongated track having a plurality of longitudinal slots opening outwardly of laterally opposite side surfaces of said track and providing access to a plurality of longitudinal electrical conductors defining at least two descrete electrical circuits, each of said longitudinal conductors lying in offset relation to the open entry end of the corresponding slot so as to prevent engagement by an object inserted straight into said corresponding open entry end, and a gripper member adapted to be mounted in straddle fashion on said track and rotated between first and second positions relative to said track, said gripper member carrying electrical contacts which are caused to project into the entry ends of selected ones of said slots on both of said opposite side surfaces of said track upon rotation of said gripper member to its said second position, said contacts being adapted for selective rotation to engage the electrical conductors within the corresponding slots only after rotation of said gripper member to its said second position on said track whereby to enable connection of a load to a selected one of the electrical circuits carried by said track.

17. The track system as defined in claim 16 wherein said elongated track has at least one longitudinal slot in each of said laterally opposite side surfaces, one of said slots providing access to a pair of discrete longitudinal conductors and the other of said slots providing access to a single longitudinal conductor, said longitudinal conductors being offset relative to the entry ends of their corresponding longitudinal slots so as to prevent access to said longitudinal conductors through straight-in insertion of an object into the entry ends of said slots, said longitudinal conductors being connectable to establish at least two discrete electrical circuits, said gripper member being adapted for mounting in straddle fashion on said track and carrying said electrical contacts so as to effect projection thereof into each of said longitudinal slots, said gripper member including actuator means operative to effect engagement of said contacts with selected ones of said offset longitudinal conductors in response to mounting of said gripping member on said track so as to enable selective connection of a load to either one of the discrete electrical circuits.

18. The track system as defined in claim 17 wherein said gripper member includes a gripper base having a shroud mounted thereon operative in a first position relative to said gripper base to enable said gripper base to be placed in straddle fashion on said track and the gripper base then rotated to effect projection of said contacts into said longitudinal slots, said shroud being movable to a locking position relative to said gripper base so as to cooperate with said track in a manner to prevent rotation and release of said gripper base from said track.

19. A track light system as defined in claim 18 wherein said electrical contacts comprise a pair of generally L-shaped contact members each of which is rotatably supported by said gripper base, said actuator means being operable in response to movement of said shroud to its said locking position to effect selective rotation of said contacts so as to engage said longitudinal conductors carried within said longitudinal slots in said track.

20. A track member for use in an electrical power system and the like, comprising an elongated track member having a substantially rectangular transverse cross-sectional configuration defining a pair of outwardly facing laterally opposite side surfaces, each of said outwardly facing side surfaces having at least one open slot extending generally longitudinally therealong, a longitudinal slot in one of said outwardly facing side surfaces having a generally L-shaped transverse cross-sectional configuration and providing access at its innermost end to a longitudinal electrical conductor disposed in offset relation to the entry end of the corresponding L-shaped slot so as to prevent direct access to the conductor through straight-in insertion of an object into the entry portion of the corresponding slot, the other of said pair of outwardly facing side surfaces having a longitudinal open slot of generally T-shaped transverse cross-sectional configuration and providing access at its innermost end to a pair of substantially parallel spaced longitudinally extending electrical conductors each of which is disposed in offset relation to the entry end of the corresponding T-shaped slot so as to prevent direct access to the corresponding conductors through straight-in insertion of an object into the entry end of the T-shaped slot, said electrical conductors being selectively connectable to a power supply to define two descrete electrical circuits.

21. A track member as defined in claim 20 wherein said track member is made from an extruded polymer, and has a metallic shroud fixed thereon in protective relation to at least one external surface of said track member.

* * * * *